United States Patent [19]

Braun et al.

[11] Patent Number: 5,064,076

[45] Date of Patent: Nov. 12, 1991

[54] SORTING PROCESS AND APPARATUS

[75] Inventors: Egon Braun; Albert Kling, both of Frankfurt am Main; Karl Heil, Eschborn; Hans-Peter Sattler, Bad Homburg, all of Fed. Rep. of Germany

[73] Assignee: Metallgesellschaft Aktiengesellschaft, Frankfurt am Main, Fed. Rep. of Germany

[21] Appl. No.: 609,293

[22] Filed: Nov. 5, 1990

[30] Foreign Application Priority Data

Nov. 9, 1989 [DE] Fed. Rep. of Germany ..... 3937265

[51] Int. Cl.[5] ..... B07B 13/11; B07C 9/00

[52] U.S. Cl. ..... 209/700; 209/642

[58] Field of Search ..... 209/642, 638, 700, 707, 209/695

[56] References Cited

U.S. PATENT DOCUMENTS

| | | | |
|---|---|---|---|
| 23,153 | 3/1859 | Booth | 209/642 |
| 1,354,063 | 9/1920 | Payne | 209/642 |
| 2,212,264 | 8/1940 | Downing | 209/642 |
| 2,212,265 | 8/1940 | Downing | 209/642 |
| 2,302,532 | 11/1942 | Downing | 209/642 |

FOREIGN PATENT DOCUMENTS

| | | | |
|---|---|---|---|
| 56453 | 6/1967 | Fed. Rep. of Germany | 209/642 |
| 9170 | 1/1977 | Japan | 209/642 |
| 1454989 | 11/1976 | United Kingdom | 209/700 |
| 89/02320 | 3/1989 | World Int. Prop. O. | 209/700 |

*Primary Examiner*—Donald T. Hajec

*Attorney, Agent, or Firm*—Sprung Horn Kramer & Woods

[57] ABSTRACT

For sorting particles of a mixed particulate material in dependence on their coefficients of sliding friction the particles are fed to a revolving endless belt which, from the feed point to the downstream discharge edge, has a length portion having a length which in dependence on the velocity of the revolving belt is so determined that only those particles of the mixed material which have the highest coefficient of sliding friction will be accelerated to the velocity of the belt while moving on the length portion, all particles having a relatively lower coefficient of sliding friction having a lower velocity at the discharge edge so that the particles which have been discharged will fly along different trajectories and are collected by correspondingly disposed devices.

13 Claims, 2 Drawing Sheets

SORTING PROCESS AND APPARATUS

DESCRIPTION

This invention relates to a process and an apparatus for sorting the particles of mixed particulate materials in dependence on their material composition with utilization of their different coefficients of sliding friction.

In this case the term mixed particulate materials describes mixtures of particles, each of which has a uniform material composition but which in their entirety constitute an aggregate of particles having different material compositions. The particle size ranges of the particles can be defined only with difficulty because economical aspects must be taken into account and depend in turn on the current monetary values of the particles which are to be separated from each other. This will particularly be applicable to the lower limit. It will be appreciated that the smallest particle size which can economically be taken into account in such separating processes will be much lower for noble metal particles than for steel particles and that that lower limit will be changed in case of an appreciable change of the prices of metals. The largest particle size which can reasonably be taken into account will primarily depend on economical criteria and on the material value of the particles. For very large particles it is necessary to provide sufficiently large transporting and separating equipment and an upper limit will certainly have been reached if the sorting of the particles by hand is less expensive.

BACKGROUND OF THE INVENTION

Published German Application 24 61 492 describes an apparatus and a process for separating particles in dependence on their coefficients of friction as the particles move under gravity on a helical chute from top to bottom. Each particle which has traveled over a minimum distance and has attained a minimum velocity will allegedly move on the helical chute at a constant radial distance from the axis of the helix, which distance will depend on the coefficient of friction of the particles, so that particles can be sorted in dependence on their coefficients of friction through a plurality of outlets which are distributed over the width of the chute. Particles having a high coefficient of friction allegedly move along narrower paths than particles having a lower coefficient of friction.

But the known process and the known apparatus still have severe disadvantages so that their economical utility is doubtful.

Because the particles are fed to the chute throughout its width, the number of particles which have a lower coefficient of friction and are initially received by the inner part of the chute will, on a statistical average, equal the number of particles which have a higher coefficient of friction and are initially received by the outer part of the chute. It will be appreciated that the paths along which said particles move will cross during the sorting operation and that the moving particles will necessarily influence each other so as to hinder the desired separation. That disadvantage is inevitable in the known process.

A further disadvantage of the known process resides in that a minimum number of convolutions is required for the helical chute but there is no upper limit for the number of convolutions. If a chute is selected which provides for a distance of travel that is distinctly larger than the minimum distance, which is not exactly defined, the result of the sorting operation will also increasingly be affected by the fact that the velocity of descent of the particles as well as their centrifugal acceleration increases and finally, when a sufficiently high velocity of descent has been attained, a further movement of all particles from the axis of the helix will finally be prevented only by the outer wall of the apparatus, regardless of the coefficients of friction of the particles. Whereas that disadvantage could be avoided in that an upper limit is defined for the distance of travel on the chute, such an upper limit just as the lower limit would have to be selected in view of the material composition of the particles and that measure would have the result that the known apparatus has a fixed overall size and a considerable expenditure would be involved in an adaptation to mixed materials having a different composition.

OBJECT OF THE INVENTION

For this reason it is an object to provide a process and an apparatus which serve to sort the particles of a mixed particulate material with utilization of their different coefficients of sliding friction and in which the disadvantages set forth cannot arise.

In the process in accordance with the invention that object has been accomplished in that a monolayer of the particles is formed on a revolving endless belt, which has from the feed point to the downstream discharge edge a length portion having a length which in dependence on the velocity of the revolving belt is so determined that only those particles of the mixed material which have the highest coefficient of sliding friction will be accelerated to the velocity of the belt while moving on said length portion and that all particles having a relatively lower coefficient of sliding friction will have a lower velocity at the discharge edge so that the particles which have been discharged will fly along different trajectories and can be collected by correspondingly disposed devices.

In accordance with further features of the process of the invention, the range of the trajectories is divided into two or three regions by adjustable deflectors and, if three regions, the intermediate fraction is recycled to the feed point of the endless belt. Advantageously the revolving endless belt has a velocity of 2 to 15 m/s and the length of the endless belt from the feed point to the discharge edge is between 0.1 and 1 m. Where needed, the process is repeated for the several fractions obtained in a cascade arrangement.

An apparatus which is desirably employed to carry out the process is characterized by a supply container, a vibrating trough, a substantially horizontally revolving endless belt trained around two reversing pulleys and driven by a controllable drive, at least one deflector, which is adjustably arranged in the range of the trajectories, and at least two collecting devices for collecting the particles of the mixed material which have been sorted in dependence on their different coefficients of sliding friction.

In accordance with further features of the apparatus of the invention, there is provided an inelastic hard support (9) under the endless belt (3) in the region between its feed point and downstream discharge edge. The endless belt may be of a grinding belt-type woven fabric, made of metal, or the like, having a coefficient of sliding friction from 0.2 to 0.8.

The invention may also be reduced to practice in a plant in which at least two apparatuses as just desribed are consecutively arranged for a flow of material as on a cascade.

A preferred use of the process and of the apparatus will be found in the removal of metal particles from a shredder scrap fraction from which the ferromagnetic particles have already been removed and which substantially contains particles of rubber, plastics and non-ferrous metals.

BRIEF DESCRIPTION OF THE DRAWING

The invention will be further described with reference to the accompanying drawing wherein.

DETAILED DESCRIPTION OF THE DRAWING

Figure 1:
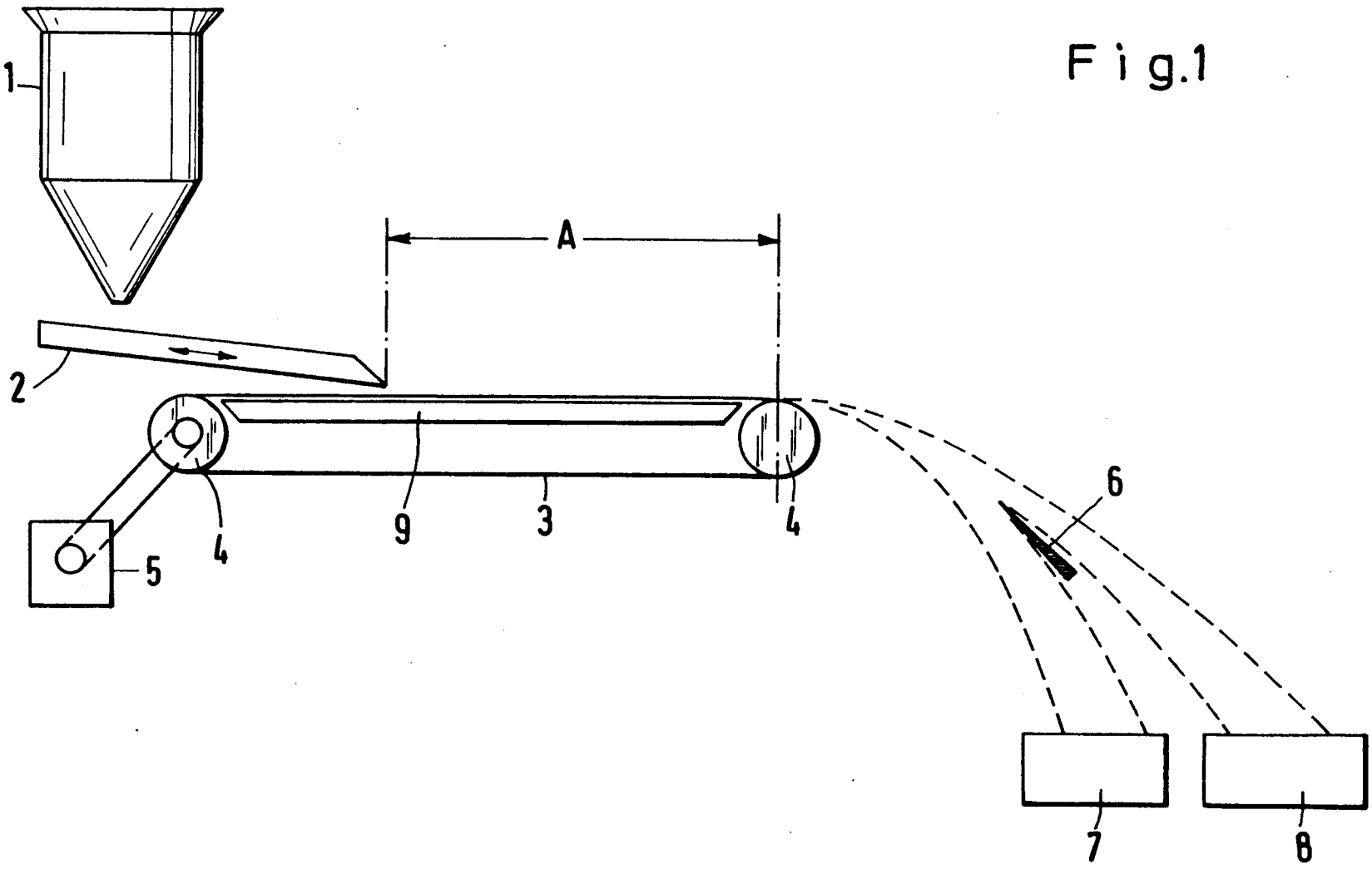
FIG. 1 is a highly simplified side elevation showing an apparatus for carrying out the process in accordance with the invention.

Referring now more particularly to the drawing, the apparatus comprises a supply container 1, a vibrating trough 2, and a substantially horizontally revolving endless belt 3, which is trained around two reversing pulleys 4 and driven by a controllable drive 5. In the range of the trajectories, indicated by a broken line, a deflector 6 is provided, which during the running-in operation is so adjusted that the sorting operation will produce the desired result. The fractions which have been obtained are collected in the collecting containers 7, 8. An inelastic support 9 is provided below the upper course of the endless belt 3 and ensures that the endless belt 3 will not be depressed more or less by the mixed particulate material which has been fed. The support 9 serves also to damp elastic impacts of the particles as they are applied to the endless belt 3 so that the particles will not rebound but will remain in contact with the endless belt throughout the length portion A.

The length of that length portion A which is required to accelerate the particles can simply be adjusted in view of given requirements in that either the endless belt 3 is displaced to the left relative to the vibrating trough 2 or the vibrating trough 2 is displaced to the right relative to the endless belt 3. Besides, the velocity of the belt can infinitely be controlled so that the apparatus can be adjusted for various applications within wide limits. The process and apparatus can be used whenever a mixed particulate material is involved in which the particles to be separated have sufficiently different coefficients of sliding friction.

An example of a sorting problem which can be solved under said conditions is the removal of metal particles from a particulate shredder scrap fraction from which the ferromagnetic particles have already been removed and which substantially contains particles of rubber, plastic and metal. Because a technically and economically acceptable process for removing from such fraction the metal particles consisting of aluminum, copper, lead, tin, zinc and non-magnetic special steel so that said particles can be re-used has not yet been available, that fraction owing to its high heating value has finally been utilized by an incineration of waste. Thereafter the metals are contained in the ash and in the filter dusts so that said materials can be disposed of only in expensive special dumps. For this reason it is a special problem how the metal content can be removed from said shredder scrap fraction so that the incineration of said fraction will finally result in materials which can less expensively be disposed of. In that case the process in accordance with the invention must so be adjusted that a metal-free residual fraction will reliably be obtained. The coefficients of friction of rubber and numerous kinds of plastic are about twice as high as those of metal (about 0.6 rather than about 0.3 under conditions of dry friction in contact with, e.g., impregnated woven fabric of polyester). For this reason said two groups of materials are highly suitable for being separated by the process in accordance with the invention. In any case a metal-free fraction can be obtained. If the shredder scrap fraction particles having coefficients of friction which are similar to those of metals it will not be possible to obtain a fraction which consists only of metals but that fraction will always contain non-metallic components and must be separated by different processes, such as separating melting, or supplied to a special dump.

In a test series the process in accordance with the invention has been applied to shredder scrap having a particle size of 15 to 33 mm. The endless belt consisted of a woven fabric of polyester and revolved at a velocity of 5 m/s. The reversing pulley at the discharge end was 160 mm in diameter and the horizontal distance from the feed point to the axis of the reversing pulley amounted to 340 mm. Two deflectors were mounted in the range of the trajectories and their horizontal and vertical distances from the axis of the reversing pulley amounted to 190 mm; +20 mm in one case and to 590 mm; −285 mm in the other case. As a result, the total amount of the charged shredder scrap, amounting to 20.2 kg, has been divided into three fractions. The first device viewed in the direction of flight contained 11.4 kg metallic particles and 3.0 kg non-metallic particles. The ratio was 1.4 kg to 2.1 kg in the second device and 0.1 to 2.2 kg in the third.

Figure 2:
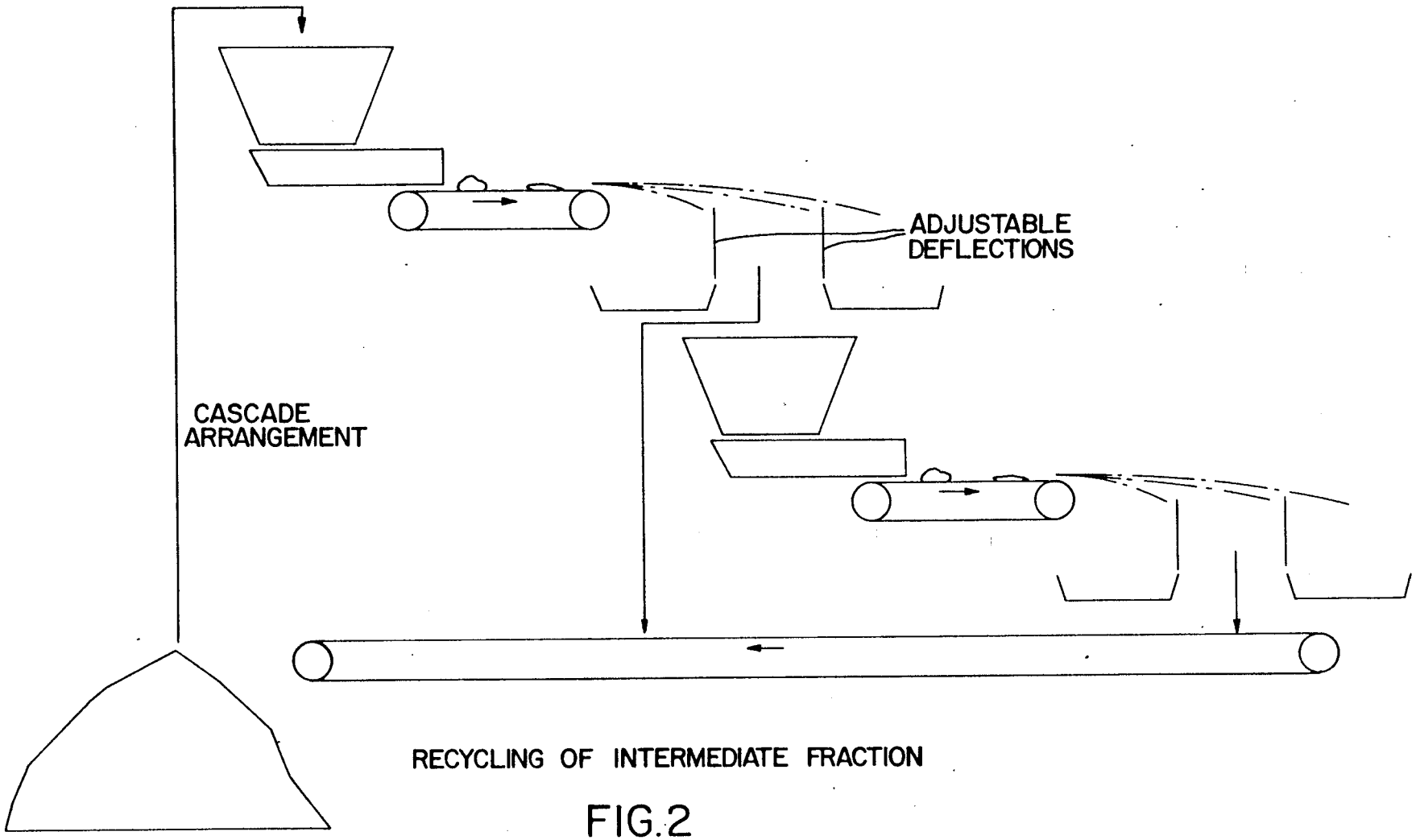
FIG. 2 is a simplified side elevation showing the apparatus in a cascade arrangement.

FIG. 2 illustrates the embodiment in which two revolving endless belts are consecutively arranged for a flow of material in a cascade. This figure also illustrates the recycling of an intermediate fraction, designated by line 10, back to the feed hopper 1.

It is apparent that the object of the process to provide a metal-free fraction to be supplied to a waste incineration plant has substantially been accomplished. The third fraction contains virtually no metal. Economically useful results of separation can be achieved with the process in accordance with the invention if the parameter setting is corrected and the critical fraction is optionally processed repeatedly.

It will be understood that the specification and examples are illustrative but not limitative of the present invention and that other embodiments within the spirit and scope of the invention will suggest themselves to those skilled in the art.

What is claimed is:

1. A process for sorting the particles of mixed particulate materials in dependence on their material composition with utilization of their different coefficients of sliding friction, comprising forming a monolayer of the particles on an endless belt, revolving such belt, the belt from the feed point to the downstream discharge edge having a length portion having a length which in dependence on the velocity of the revolving belt is such that only those particles of the mixed material which have the highest coefficient of sliding friction will be accelerated to the velocity of the belt while moving on said length portion and that all particles having a relatively lower coefficient of sliding friction will have a lower velocity at the discharge edge, whereby particles will be discharged from the belt, will fly along different trajectories and separately collecting the discharged particles.

2. A process according to claim 1, wherein the range of the trajectories is divided into two regions by adjustable deflector.

3. A process according to claim 1, wherein the range of the trajectories is divided into three parts by two adjustable deflectors and the intermediate fraction is recycled to the feed point of the endless belt.

4. A process according to claim 1, wherein the revolving endless belt has a velocity of 2 to 15 m/s.

5. A process according to claim 1, wherein the length of the endless belt from the feed point to the discharge edge is between 0.1 and 1 m.

6. A process according to claim 1, wherein the process is repeated for the several fractions obtained in a cascade arrangement.

7. A process according to claim 1, wherein the mixed particulate materials comprise a shredder scrap fraction from which the ferromagnetic particles have been previously removed and which substantially contains particles of rubber, plastic and non-ferrous metals, the process serving to remove metal particles from the mixed particulate material.

8. An apparatus for carrying out the process according to claim 1, comprising a supply container (1), a vibrating trough (2), a substantially horizontally revolving endless belt (3) trained around two reversing pulleys (4) and driven by a controllable drive (5), at least one deflector (6) adjustably arranged in the range of the trajectories, and at least two collecting devices (7, 8) for collecting the particles of the mixed material which have been sorted in dependence on their different coefficients of sliding friction.

9. An apparatus according to claim 8, including an inelastic hard support (9) under the endless belt (3) in the region between its feed point and downstream discharge edge.

10. An apparatus according to claim 8, wherein the endless belt (3) is a grinding belt-type woven fabric.

11. An apparatus according to claim 8, wherein the endless belt (3) is made of metal.

12. An apparatus according to claim 8, wherein the endless belt has a coefficient of sliding friction from 0.2 to 0.8.

13. At least two apparatuses according to claim 8, arranged so as to act consecutively on a flow of material in a cascade.

* * * * *